US006559365B2

(12) United States Patent
Wilfer

(10) Patent No.: US 6,559,365 B2
(45) Date of Patent: May 6, 2003

(54) STAND

(76) Inventor: Hans-Peter Wilfer, Zum Hackerhof 5, D-08258 Markneukirchen (DE)

( * ) Notice: Subject to any disclaimer, the term of this patent is extended or adjusted under 35 U.S.C. 154(b) by 0 days.

(21) Appl. No.: 09/941,117

(22) Filed: Aug. 28, 2001

(65) Prior Publication Data

US 2002/0124711 A1 Sep. 12, 2002

(30) Foreign Application Priority Data

Mar. 6, 2001 (DE) ..... 201 03 849 U
Mar. 22, 2001 (DE) ..... 201 05 113 U

(51) Int. Cl.[7] ..... G10D 3/00
(52) U.S. Cl. ..... 84/327; 84/290
(58) Field of Search ..... 84/327, 328, 329, 84/290

(56) References Cited

U.S. PATENT DOCUMENTS 5,505,413 A * 4/1996 Hennessey ..... 248/166
5,664,756 A * 9/1997 Liao ..... 248/443
5,852,250 A * 12/1998 Cha ..... 84/327
6,127,612 A * 10/2000 Yu ..... 84/327
6,281,417 B1 * 8/2001 Ladao ..... 211/85.6
6,316,706 B1 * 11/2001 Sammons ..... 84/327

* cited by examiner

*Primary Examiner*—Kim Lockett
(74) *Attorney, Agent, or Firm*—Sidley Austin Brown & Wood, LLP

(57) ABSTRACT

A stand for at least one elongated musical instrument having a narrow end and a wide end and including a base for setting the stand on an essentially horizontal plane, a substantially vertically oriented midsection, at least one support assembly, and at least one yoke, with a rigid latch element, with the support assembly supporting the wide base end of the musical instrument and the yoke receiving the narrow head end of the musical instrument.

12 Claims, 3 Drawing Sheets

STAND

BACKGROUND OF THE INVENTION

1. Field of the Invention

The invention relates to a stand for musical instruments and including a case for setting the stand on a substantially planar surface, a substantially vertically oriented midsection, at least one support assembly for supporting a wide base end of the musical instrument, and at least one yoke arranged on the support assembly for receiving the narrow head end of the musical instrument.

2. Description of the Prior Art

Musical instruments are particularly sensitive to external mechanical effects. Even a slight contact with the tuning mechanism of a guitar or of a string instrument can adversely affect the tonal qualities of the instrument. Musical instruments must be set aside in such a manner, that their sensitive components are not exposed to contact with the floor, the wall or passers-by. There are devices available for holding or otherwise accommodating almost any portable musical instrument and which can be adapted to the shape of the instrument. With such devices the musical instrument is supported in those areas that are relatively mechanically insensitive.

Numerous stands are known in the art that are intended for elongate musical instruments having a narrow end and a wide end such as, for example, guitars, bass guitars, string and similar instruments, and that provide a statically stable support for the musical instrument. However, this requires that the musical instrument is placed precisely into the stand by the user. Even minor deviations from the prescribed position can result in the musical instrument being located in uncertain equilibrium. In such a case, even a minor impact could be sufficient to cause the instrument to fall to the floor. This could result in detuning or even damage of the musical instrument.

U.S. Pat. No. 5,375,497 discloses a stand for elongate instruments, in particular guitars. The stand comprises a base and a generally vertical main section. The base is provided for set-up of the stand on a generally flat surface. The vertical main section has, in its lower portion, a support assembly for the wider end portion of the musical instrument. At the upper end of the vertical main section, a C- or U-shaped yoke is provided for the accommodation of the narrower end portion of the musical instrument.

With said stand, a musical instrument, in particular a guitar, can be stably stowed.

The drawback of the known device consists in that the U- or C-shaped yoke does not adequately enclose the narrower end portion of the musical instrument. Even a light impact could be sufficient to cause the musical instrument to fall from its stand. Such an incident during a concert could jeopardize the course of the entire event. It is desireable, that the expensive musical instrument can be safely stowed.

It is, therefore, an object of the present invention to provide a stand of the type disclosed above out of which the musical instrument cannot fall.

SUMMARY OF THE INVENTION

This and other objects of the present invention, which will become apparent hereinafter, are achieved by providing the yoke with a rigid latch element. Thus, the narrow end portion of the musical instrument is at least enclosed in such a way that it cannot tip out of the yoke. The musical instrument is thus prevented from falling out of the stand.

Preferably, the latch element is held in a closed position by an elastic retaining force, in particular by a spring. In this way, the latch cannot be inadvertently opened. A user must overcome the resistance of the spring in order to open the latch.

Furthermore, the latch element can be coupled with the yoke by a hinge. In this way, the yoke can be flipped open and closed. An easy-to-operate but efficient device is, thus, provided. In the closed condition, the hinged latch element can be located at the opposing end of the yoke. Alternatively, the latch element can be shorter than the space between the two ends of the yoke, with the hinge being provided with an appropriate stop.

Alternatively, a sliding latch element, which is housed inside the yoke, can be provided. This would provide for a compact construction of the yoke. In this case, it is not absolutely necessary that the yoke and the latch element form a closed ring. There can be sufficient gap between the latch element and the opposing end of the yoke. The gap must, however, be so dimensioned that the narrow end portion of the musical instrument is reliably prevented from tipping out of the yoke.

Advantageously, the midsection can be made longitudinally adjustable along its length so that the stand can be adapted to the dimensions of the musical instrument. This can be achieved by providing, in the midsection, adjustable telescopic means, or by using fixing screws. In this manner, a compact construction of the stand is obtained.

Furthermore, the stand can be made collapsible and/or separable. This characteristic is particularly desirable, because such stands are frequently used at musical events or tournaments.

Preferably, the base includes a tripod. In this way, a particularly lightweight construction is obtained, and the stand can be particularly easily disassembled. Furthermore, a relatively large standing base area is created, whereby it is almost impossible for the stand to fall over.

Alternatively, the base can include a plate. By using a heavy plate the common center of gravity of the stand and the musical instrument is relatively low, which has a positive effect on stabiity.

Furthermore, the support assembly can be adjustably attached to the midsection. Likewise, the yoke can be adjustably attached to the midsection. These modifications provide additional options for adapting the geometric dimensions of the stand to the dimensions of a musical instrument. If the stand is intended for several musical instruments, musical instruments of different sizes can thus be accommodated. In the normal case, the musical instruments are held loosely in the yoke pursuant to the invention and are merely prevented from tipping out of it. Alternatively, the musical instruments can be held securely in position, preferably clamped, at their narrow end portions, across the necks of guitars and bass guitars.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
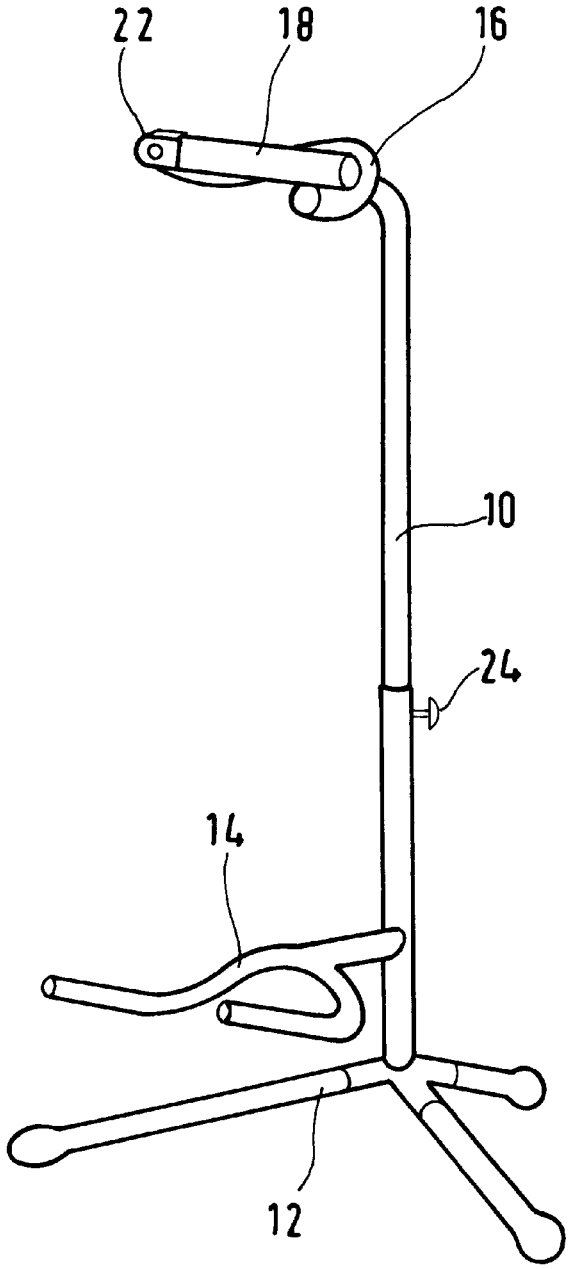
FIG. 1 a perspective view of a first embodiment of a stand for a musical instrument according to the present invention.

A stand according to the present invention and shown in FIG. 1 includes a longitudinally adjustable shaft 10. The shaft 10 is formed of a vertical, elongate, two interfitting tubes slidably inserted into each other. For the purpose of fixation of the two tubes in a predetermined position, a manually adjustable screw 24 is provided. At the lower end of the shaft 10, the stand has a base 12 which is formed as a tripod. Above the base 12, a support assembly 14 is attached to the shaft 10. The support assembly 14 is formed as a yoke and is arranged generally horizontally. A U-shaped yoke 16 is attached to the upper end of the shaft 10. The yoke 16 is generally arranged horizontally and is located on the same side of the shaft 10 as the support assembly 14. A latch element 18 extends between the two ends of the yoke. The latch element 18 is attached to the one end of the yoke 16 with a hinge 22. The hinge 22 comprises a spring that biases the latch element 18 against the opposite end of the yoke 16. The yoke 16 and the latch element 18 together form a closed ring.

The inventive stand is intended to receive a musical instrument, in particular a guitar or similar instrument. The body of the musical instrument is placed upon the support assembly 14, and the neck of the instrument is enclosed by the yoke 16 and the latch element 18. In order to open the yoke 16, a user must overcome the action of the spring and flip the latch element 18 upwards. Conversely, the closure of the yoke 16 occurs automatically due to the action of the spring. Thus, unintentional opening of the latch element 18 is excluded. In this way, instrument is prevented from falling out of the stand. Alternatively, the latch element 18 can be formed shorter than the gap between the two ends of the yoke 16. Consequently, the latch element 18 does not lie upon the opposite end of the yoke 16, but the angular area of the hinge 22 is correspondingly restricted. A gap is created between the latch element 18 and the opposite end of the yoke 16. The width of the gap is narrower than the width of the musical instrument at the corresponding position. In this position, too, the musical instrument cannot fall out of the stand.

It is also almost impossible for the stand to tip over together with the musical instrument. On one hand, the common center of gravity of the stand and the musical instrument is relatively low; namely, it is generally not located higher than the support assembly 14. On the other hand, the center of gravity is almost in the center of the stand base plane which is defined by the base 12. Thus, the stand pursuant to the invention makes possible a safe and secure stowing of musical instruments.

Figure 2:
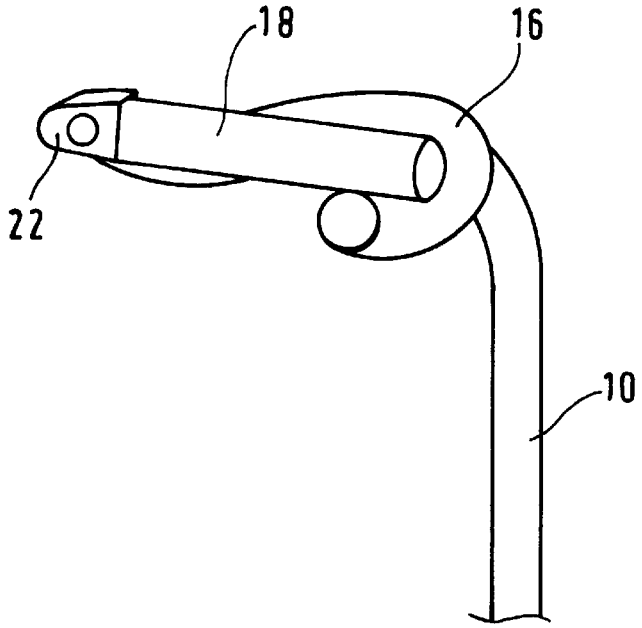
FIG. 2 a perspective view of an upper portion of the stand pursuant to FIG. 1, in the closed condition.
Figure 3:
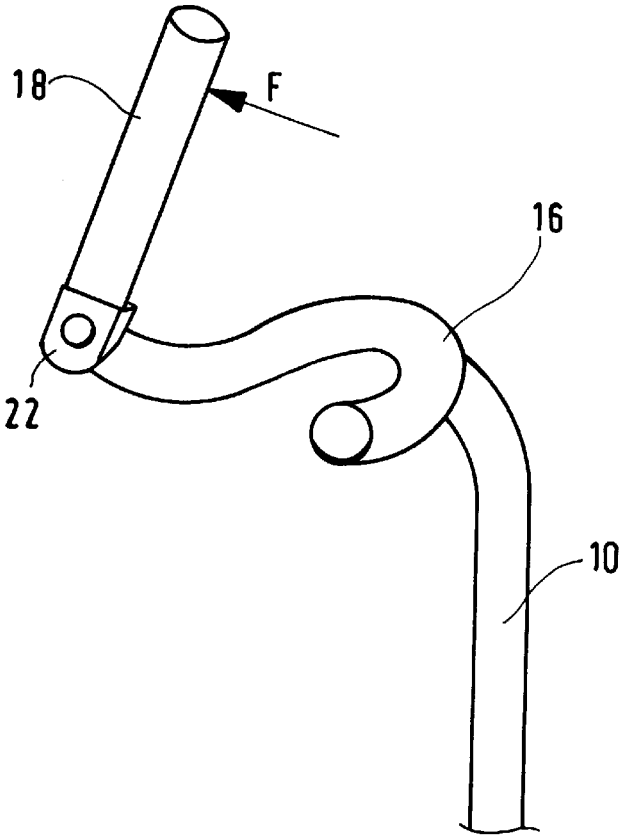
FIG. 3 a perspective view of the upper portion of the stand pursuant to FIG. 1, in the open condition.

FIG. 2 shows the upper part of the inventive stand pursuant to FIG. 1 at an increased scale. The latch element 18 is shown in the closed position. FIG. 3 also shows the upper part of the stand but with the latch element 18 in the open position. The vector F means that the user must apply a force, even if only slightly, to hold the latch element 18 in the open position. Both FIGS. 2 and 3 show together the latch element 18 is formed as a barrier bar.

Figure 4:
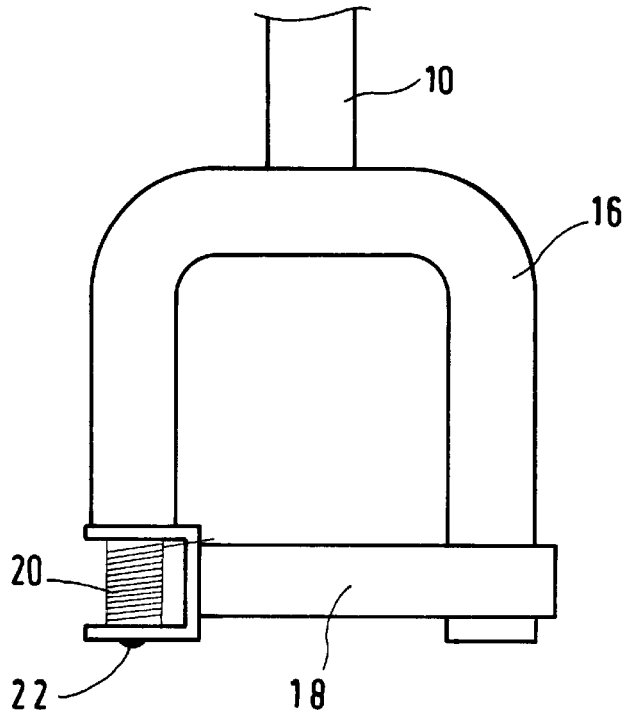
FIG. 4 a top view of the upper portion of the stand pursuant to FIG. 1, and according to the present invention.

FIG. 4 shows a top view of the upper part of the stand pursuant to FIG. 2. A helical spring 20 is associated with the hinge 22. The helical spring 20 retains the latch element 18 in the closed position. The force of the spring 20 must be of such a dimension that the latch element 18 is merely held closed. In particular, the force of the spring 20 is not required to provide a counter-force in the event the musical instrument is pressed against the latch element 18. The degree of freedom of play for the movement of the latch element 18 is determined so that a force from the musical instrument side is always directed perpendicular to the predetermined direction of movement of the latch element 18.

Furthermore, the stand pursuant to the invention is made collapsible and/or separable. The base 12 configured as a tripod is collapsible or foldable with minimum effort. Also the other components serve to make it possible to easily fold or dismantle the stand to a portable format. This is particularly advantageous, because such stands are used predominantly at musical events or at tournaments.

Alternatively, the base 12 can be formed as a solid plate. In this manner, a particularly high stability is achieved due to the extremely low center of gravity. Because of the lengthwise adjustability of the shaft 10, the stand can be used for musical instruments of different sizes. The inventive stand is suitable not only for a guitar or a bass guitar, a violin, but also for a contrabass. Further, the stand can be provided with interchangeable component parts pursuant to the modular construction principle. For example, several support assemblies 14 can be provided for the stand that are intended for various musical instruments of different sizes. The support assemblies 14 can be adapted individually to specific musical instruments. Similarly, the stands can be provided with an interchangeable yoke 15 complete with the latch element 18. In this manner, the stand can be used for musical instruments whose geometry deviates from the aforementioned instruments. For example, the stand can also be used for supporting a saxophone.

Furthermore, special embodiments of the invention can be provided for accommodation of several musical instruments at the same time, whereby each musical instrument has its own support assembly 14 and its own yoke 16, which are arranged around the shaft 10. By using several height-adjustable support assemblies 14 and/or yokes, several musical instruments of different sizes can be supported at the same time. Interchangeable support assemblies 14 and/or yokes 16 make possible contemporaneous stowing of musical instruments of various types. A stand pursuant to FIG. 1 can easily accommodate support assemblies 14 and/or yokes for two, three, or four musical instruments.

Figure 5:
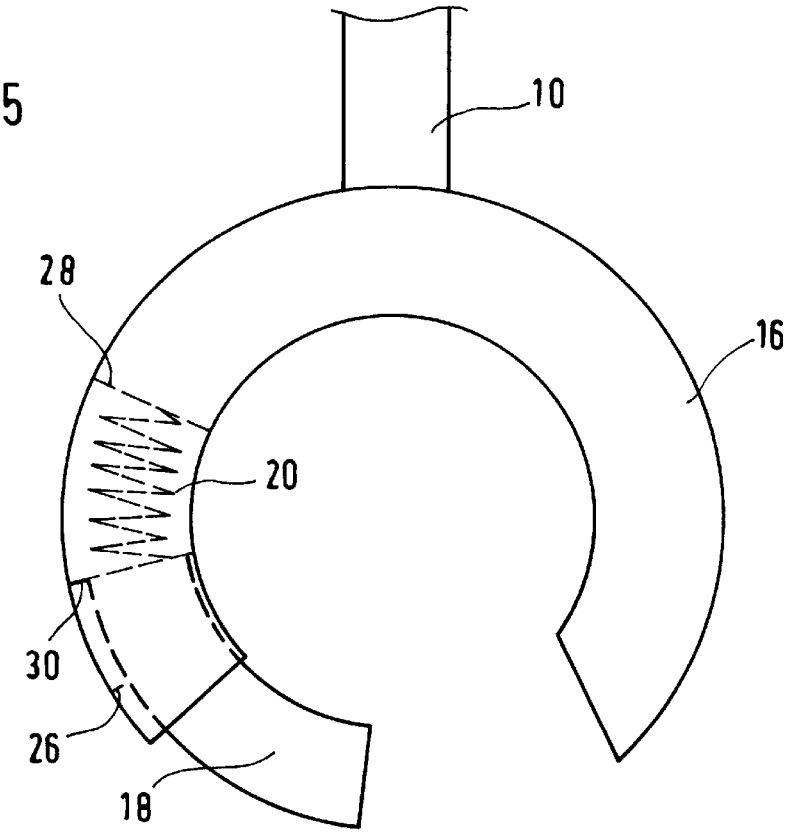
FIG. 5 a top view of an alternative embodiment of the upper portion of a stand.

An alternative embodiment of the stand pursuant to the invention is shown in FIG. 5. FIG. 5 shows the upper part of an alternative stand as viewed from above. The alternative embodiment likewise includes a shaft 10, a C-shaped yoke 16, a latch element 18, and a spring 20. In lieu of the hinge 22, however, the alternative embodiment includes a sliding bearing. The latch element 18 has a circular protrusion 30 surrounding the latch element 18. The yoke 16 has an internal stop 26 and an additional stop 28.

In the alternative embodiment of the inventive stand pursuant to FIG. 5, the latch element 18 is displaceably mounted inside the yoke 16. The movement of the latch element 18 is limited in the closed position by the protrusion 30 and the stop 26, and in its open position by the stop 28. The alternative embodiment is maintained in the closed position by a spring 20. In this alternative embodiment, too, it is not absolutely necessary that the yoke 16 and the latch element 18 form a closed ring. Between the latch element 18 and the other end of the yoke 16 an open area can exist, which is merely needs to be narrower than the corresponding area of the musical instrument in order to achieve the desired security. Also the alternative closure assembly is automatically held in the closed position by the spring 20.

With the stand pursuant to the invention, a device is provided that, with relatively low constructive expense, provides safe and secure stowing for generally highly valuable musical instruments.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A stand for at least one elongate musical instrument having a narrow head end and wide base end, comprising:

a base for setting up the stand on an essentially planar surface;

a substantially vertically oriented elongated midsection;

at least one support assembly for supporting the wide base end of the musical instrument;

at least one U-shaped yoke arranged on the support assembly for receiving the narrow head end of the musical instrument and having a base for supporting the narrow head end; and a pivotal ridge latch element arranged opposite the yoke base for preventing the musical instrument from falling out of the stand.

2. A stand pursuant to claim 1, comprising means for retaining the latch element in the closed position.

3. A stand pursuant to claim 2, where in the retaining means comprises a spring.

4. A stand pursuant to claim 1, further comprising a hinge for coupling the latch element to the yoke.

5. A stand pursuant to claim 1, further comprising a slide bearing for coupling the latch element to the yoke.

6. A stand pursuant to claim 5, wherein the latch element is displaceably mounted inside the yoke.

7. A stand pursuant to claim 1, wherein the midsection is lengthwise adjustable along its length.

8. A stand pursuant to claim 7, wherein the length of the midsection (10) is continuously adjustable.

9. A stand pursuant to claim 1, wherein the stand is at least one of collapsible and separable.

10. A stand pursuant to claim 1, wherein the supporting assembly is height-adjustable and is supported on the midsection.

11. A stand pursuant to claim 1, wherein the yoke is adjustably supported on the midsection.

12. A stand pursuant to claim 1, comprising a plurality of support assemblies and yokes for supporting a plurality of instruments.

* * * * *